United States Patent [19]

Chambers

[11] 4,386,725

[45] Jun. 7, 1983

[54] STAPLER APPARATUS WITH MEANS TO DETERMINE STAPLE SUPPLY

[75] Inventor: James E. Chambers, Williamson, N.Y.

[73] Assignee: Xerox Corporation, Stamford, Conn.

[21] Appl. No.: 203,741

[22] Filed: Nov. 3, 1980

[51] Int. Cl.[3] ..... B27F 7/00; B27F 7/34

[52] U.S. Cl. ..... 227/2; 227/110; 227/120

[58] Field of Search ..... 227/2, 120, 110

[56] References Cited

U.S. PATENT DOCUMENTS

| | | | |
|---|---|---|---|
| 1,586,583 | 6/1926 | Skrebba | 227/110 X |
| 3,098,576 | 7/1963 | Steward | 227/2 |
| 3,141,171 | 7/1964 | Doyle et al. | 227/2 |
| 3,380,639 | 4/1968 | Francis et al. | 227/4 |
| 3,477,628 | 11/1969 | MacEachron | 227/110 |
| 3,685,712 | 8/1972 | Turner et al. | 227/3 |
| 3,743,158 | 7/1973 | Cohn et al. | 227/110 X |
| 4,187,969 | 2/1980 | Spehrley, Jr. | 227/2 |
| 4,231,210 | 11/1980 | Nagode | 227/110 X |

OTHER PUBLICATIONS

Swingline Model 747 Stapler.

*Primary Examiner*—Paul A. Bell
*Attorney, Agent, or Firm*—Bernard A. Chiama

[57] ABSTRACT

A monitoring device is described for use with a movable stapler apparatus to detect the presence or absence of staples at a predetermined point during staple movement in the magazine therefor. The monitoring is accomplished during any positions which the apparatus may assume by means of a light emitter and a light detector arranged on opposite sides of the magazine to sense the transmission of light through aligned openings in the magazine as an indication of a low staple supply condition in the magazine.

2 Claims, 4 Drawing Figures

28
22
26
13
20
60
24
14
12
11

STAPLER APPARATUS WITH MEANS TO DETERMINE STAPLE SUPPLY

This invention relates to improvements in stapling apparatus for attaching sheets of paper. The present invention is particularly applicable to stapling devices, finishers and the like which are associated with copying machines having a finishing assembly which receives processed copy sheets in collated sets and then stapled for use by an operator.

In some copy machines which employ displaceable staplers in high speed production runs, use is generally made of a stapler which stores large quantities of staples in the form of a coiled ribbon in order to avoid constant reloading of the staple supply. However, ribbon type staples present problems in that the materials and methods utilized for tacking the staples together sometimes fail and at all times the tacking material becomes deposited upon finished copy sets thus resulting in unsightly production copy sets. On the other hand, other types of displaceable stapler devices which utilize U-shaped staples and are supplied in the form of a single stick of staples are very inconvenient in that a stick does not contain sufficient numbers of staples. Since the stapler devices are displaceable, that is, they are moved into and out of a work or stapling position, there is no provision for quickly determining when a stick is nearly exhausted for permitting resupplying, perhaps even while the stapling device is in operation.

The prior art does disclose various arrangements for monitoring staple supply in a stapling apparatus. However, the art is not concerned with the problem of monitoring a stapler which is moved as a total unit from one position to another, such as from an inoperative position to a working position whereat stapling is achieved. In U.S. Pat. No. 4,187,969, the staple detecting system is applied to a fixed stapling device and there is no disclosure as to the actual path of the detecting light rays through the structure of the device. The U.S. Pat. No. 3,685,712 utilizes a lamp and phototransistor system to detect when a staple roll shows no staples. In the disclosed machine, there is no fully moving stapler apparatus and the whereabouts and details as to actual monitoring is not present. In the U.S. Pat. No. 3,380,639, a mechanical staple monitoring system is disclosed as applied to a fixed stapler apparatus. In addition, the details of the monitoring system is directly connected to the stapler apparatus and would be subject to the extreme vibration produced thereby.

It is believed that the scope of the present invention as defined by the appended claims is clearly patentably distinguished over the above described prior art.

In the companion U.S. patent application Ser. No. 203,742, commonly assigned and filed on the same date herewith, an arrangement is disclosed to monitor the low staple supply condition of a staple magazine utilizing a fiber optic bundle to direct light on a staple stick and a light detector to receive the resultant reflected light when staples are still present. In the present invention, the transmission of light through the magazine is utilized in determining whether or not a low staple supply condition exists.

The principal object of the present invention is to improve stapling operation of a movable stapler device by monitoring the supply of staples as the same is being consumed and to alert the operator of a low supply staple condition.

Further objects and advantages of the present invention are set forth or will appear from the following specification which describes a preferred form of the invention by way of example and is illustrated by the accompanying drawings wherein.

Figure 1:
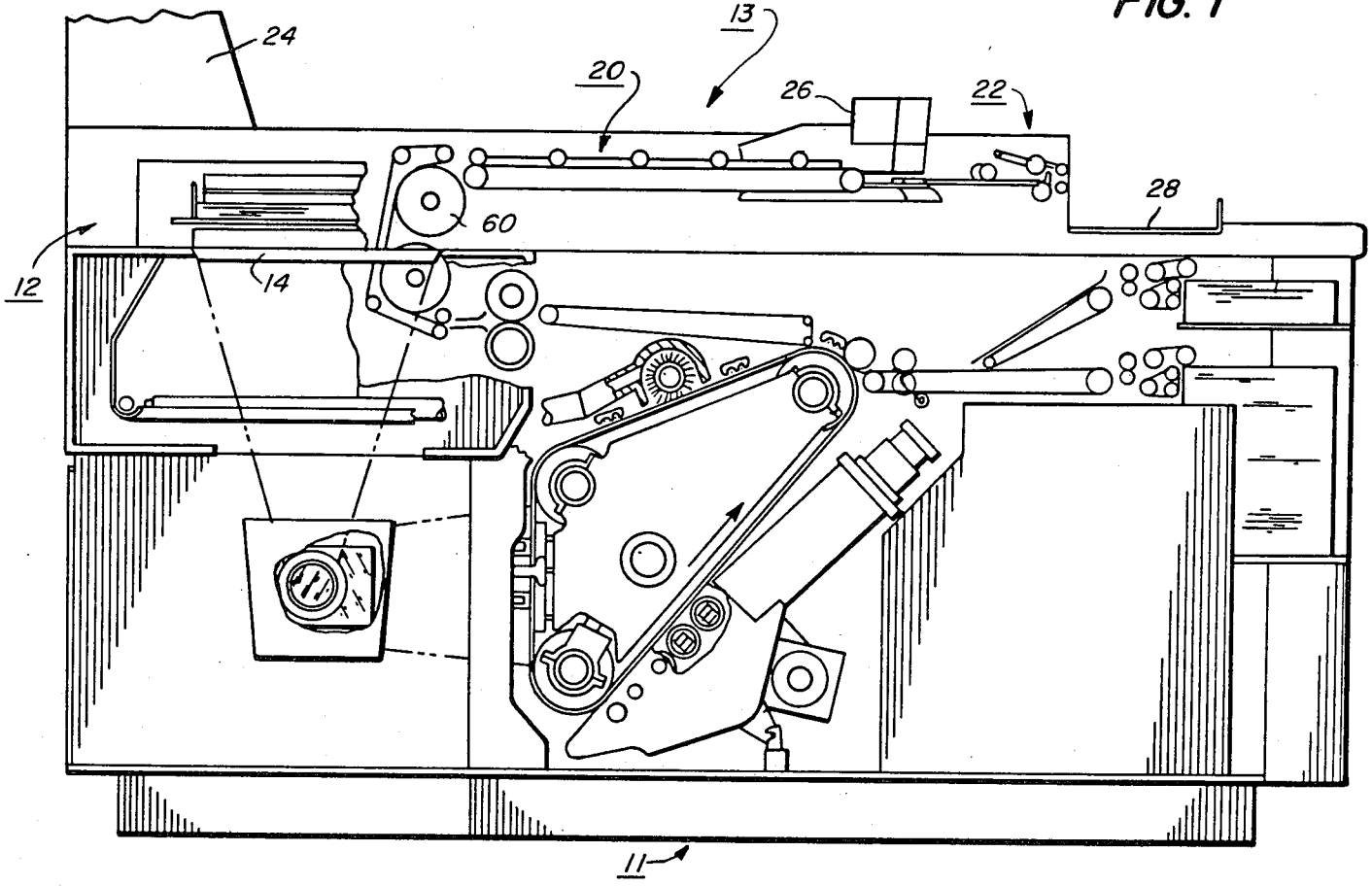
FIG. 1 is an elevational view of a copying machine to which the improved stapler apparatus is applied.
Figure 2:
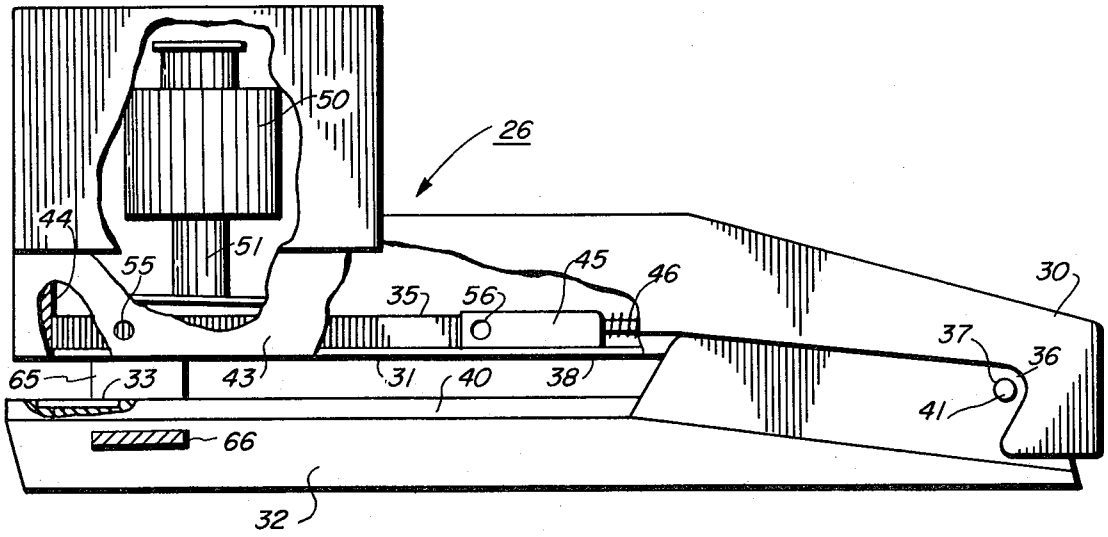
FIG. 2 is a side elevational view of an electromechanical operable stapling apparatus embodying the principles of the present invention.

For a general understanding of a copying machine with which the present invention may be incorporated, reference is made to FIG. 1 wherein components of a typical electrostatic printing system are illustrated. The printing system is preferably of the xerographic type as one including a xerographic processor 11, a document handling apparatus 12 and a finishing station 13. Preferably, the system is the same as the commercial embodiment of the Xerox machine model 8200 which utilizes a processor adapted for flash, full frame exposure, for very high speed production. It will be understood that any other type of xerographic processor or printing system may be utilized.

Further details of the processing devices and stations in the printer system are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein. As to the particular copying machine illustrated in FIG. 1, further details are disclosed in U.S. Pat. No. 4,313,670, filed Oct. 30, 1979, commonly assigned and which is incorporated by reference.

As disclosed in the above referred to patent application, each sheet of paper exiting the processor 11 is conveyed into a transport assembly 20 arranged above the processor. In the assembly 20, a sheet undergoes a coarse registration alignment along one edge and slight corrugation shaping in order to condition the same for further treatment.

From the assembly 20, sheets are conveyed to a compiler assembly 22 where the sheets are compiled until a complete set of copy sheets corresponding to the set of document sheets in the document handling apparatus 12 have been collected. Upon receiving the last copy sheet of a preprogrammed set and the stapling function has been programmed in a control panel 24, a control signal is generated to effect pivotal displacement of a power driven stapler device 26, into position adjacent one corner of the compiled set, a stapling activation thereof, and return of the stapler device 26 to its inoperative initial position to await another control signal. After a set has been stapled, the set of copy sheets are transported to a catch tray 28 to await removal therefrom by an operator, either at that time or after the tray has been allowed to collect a suitable number of sets.

The stapler apparatus may be any suitable type presently in commercial use which utilizes a power solenoid and a stapling head for separating a staple from a supply and driving the legs of the staple through a number of sheets of paper. The apparatus would also include a passive clinching device to bend the legs of the staple inwardly so as to fasten the sheets into a permanent set.

In the specification and accompanying drawings, the stapler apparatus disclosed for which the present invention is embodied for illustration purposes only, is a solenoid operated implement. It is to be understood that this utilization is only for exemplary purposes and that the stapling apparatus of the present invention is also applicable to other finishing stapler heads utilized in conjunction with a copying machine.

The stapling apparatus 26 to which the present invention is embodied comprises a housing 30 containing a stapling head member 31 pivotally movable within the housing, and a base 32 which supports a passive clinching anvil 33. The upper portion of the base 32 also houses a magazine containing a stick of staples 35 which may be suitably inserted into the base by conventional means.

The base 32 is formed with upstanding ears 36 having mating apertures 37 which are adapted to register with corresponding apertures formed in lower portion 38 of the stapling head 31 and in the upper member 40 of the base 32. A pin 41 is disposed within all of the mating apertures to secure the housing 30 and stapling head member 31 to the base 32. The pin 41 also extends through apertures formed to attach the portion 38 and member 40 to one another. A suitable return spring (not shown) maintains the normal spaced relationship of the stapling head 31 to the anvil 33.

While the invention has been described and illustrated as embodied in a stapling device of the generally conventional, power operable type for driving a staple through a set of sheets of paper and against a passive anvil, it is to be understood that the present invention is adapted for use with other stapling devices which are manually operable or fully power operated; that is, the power being generated is utilized to effect the clamping, driving and clinching of a plurality of sheets of paper.

The magazine in the base 32 is preferably constructed of sheet metal formed into a trough-shaped, elongated channel with upstanding sides 43 and closed at its forward end by a vertical wall 44 which limits the removal of staples 35 from the magazine and defines the dispensing means for the staples from the magazine. At this forward end of the magazine, the wall 44 defines a cutaway (not shown) which serves as an open guideway for the egress of staples when driven out of the stapler device.

The stick of staples 35 is received in the magazine in the conventional manner and a magazine follower 45 is also provided in the magazine for urging the stick forward against the stop 44 to maintain the outermost staple in alignment with the guideway through which staples are driven during a stapling operation. The magazine follower 45 is slidably mounted in the magazine and is urged forward theralong by a spring 46 held in compression between the adjacent end of the magazine follower and the rear wall (not shown) of the magazine.

For actuating the stapler in a stapling action, there is provided a solenoid 50 having a plunger 51 arranged to bear down on the internal structure of the lower member 38 of the stapling head member 31 to pivot the same downwardly therby bringing the wall 44 in contact with the anvil 33. Actuation of the plunger 51 also effects the separation of a staple from the stick 35; and the driving of the same through a set of copy sheets positioned between the wall 44 and the anvil and clinching of the legs of the staple against the anvil.

In accordance with the present invention, means are provided for informing the operator of a low staple supply condition for the staples 35. To this end, the upstanding sides 43 which serve as a staple guide, are formed with aligned openings 55 to expose the staples 35 for detecting therethrough. The openings 55 are adjacent the forward end wall 44 and cooperate with aligned openings 56 in the magazine follower 45 so that when the magazine follower has moved forward to a point wherein a predetermined number of staples are between the forward end of the magazine follower and the wall 44, the openings 55, 56 will be aligned to permit the passing of light therethrough.

Generally, commercially available staple sticks comprise 210 staples. In use in high speed copy and stapling machines, and at high anticipated usage rates, a stick can be consumed rapidly. It is therefore desirable to provide indication to the operator that the staple supply in the magazine for a stapler is running low when a stapling machine is in a automatic mode of operation. By introducing light into one of the opening 55 and detecting the presence or absence of the light, it may be determined that the predetermined number of staples exist in the magazine. Assuming this number to be five staples, when the fifth or last staple moves past the series of aligned openings 55, 56, the light will be transmitted completely through the openings to be an indication of a low staple supply condition.

Figure 3:
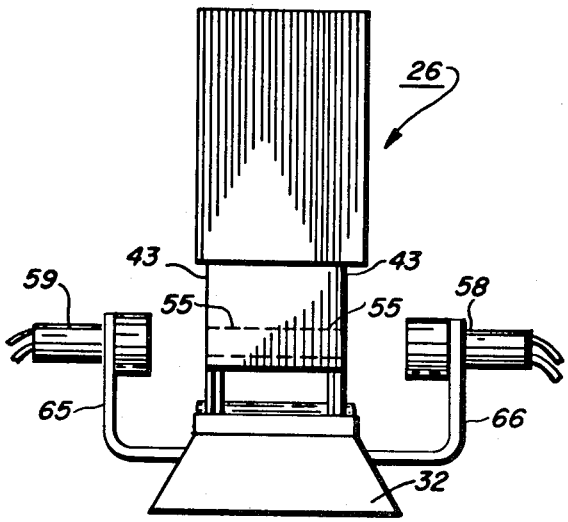
FIG. 3 is a front view of the stapling apparatus with a monitoring system utilized in the present invention.

As shown in FIG. 3, a two piece, transmissive, optoelectronic sensor comprising a light emitter 58 and a light detector 59 is arranged one one each side of the stapling apparatus adjacent the side walls 43. The emitter 58 is mounted on the base 32 for the stapler apparatus by way of a bracket 65 while the detector 59 is secured by way of a bracket 66 to the base. During pivotal displacement of the apparatus 26 between its inoperative position and its stapling position, the sensor components 58, 59 move therewith thereby assuring full time monitoring of the staple supply. By being mounted on the base 32, the components do not have direct contact with the stapling head 31 and the extreme vibrations which this device produces. In this manner, the sensor is protected from experiencing unwanted conditions which may produce premature wear and fatigue, while still being positioned for full time monitoring.

Figure 4:
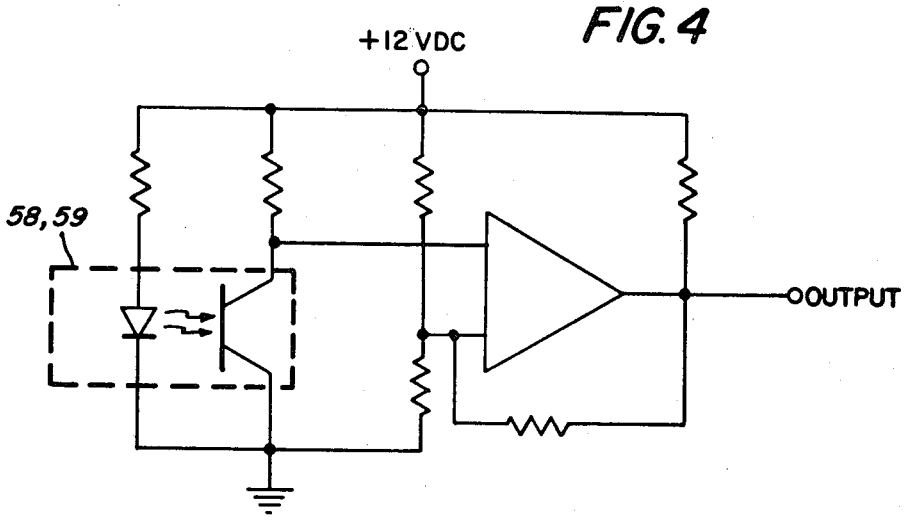
FIG. 4 is a circuit diagram which may be utilized for detecting a low staple condition.

The sensor 58, 59 is suitably connected in a logic circuit, as shown in FIG. 4, arranged to sense the presence or absence of light condition through the openings 55, 56 to energize a warning device such as an indicator light of the low supply staple supply condition. The output of this circuit may also be devised to place the host reproduction machine in its standby condition in the event that the staple supply has become exhausted.

From the foregoing it will be apparent that a stapling apparatus of the type which is moved into and out of a work position has been described in combination with a copying machine which will permit full time monitoring of the staple supply and, if need be, to terminate stapling operation in the event the number of staples becomes too low. It will also be appreciated that the means for monitoring may be applied to many commercial machines easily and at very little cost.

While the invention has been described with reference to the structure disclosed, it is not confined to the details set forth, but is intended to cover such modifications or changes as may come within the scope of the following claims.

I claim:

1. In a printer machine having a stapler apparatus being movable between an inoperative position and a work position and having a staple magazine for holding a supply of staples in stick form movably related to a staple drive member during a stapling operation, the magazine being provided at an end thereof with staple dispensing means; an anvil member; and a base member for supporting the anvil; the anvil member and the staple dispensing means being adapted to cooperate to permit individual ones of the staples to be dispensed toward and against the anvil member during a stapling operation, the improvement wherein:

the magazine is formed with aligned openings positioned at a predetermined point and past which staples move during consumption when the stapler apparatus is in operation, means for directing light rays through said openings and for detecting exiting thereof as indicative of the passing of the last staple in the magazine, means for producing a signal when said openings are in alignment as indicative of a low staple supply condition in the magazine, and means for mounting said means for directing light rays and said means for producing a signal to the base member of the apparatus to be movable therewith.

2. In a printing machine having a stapler apparatus being movable between an inoperative position and a work position and having a staple magazine for holding a supply of staples in stick form movably related to a staple drive member during a stapling operation, the magazine being provided at an end thereof with staple dispensing means; an anvil member; and a base member for supporting the anvil; the anvil member and the staple dispensing means being adapted to cooperate to permit individual ones of the staples to be dispensed toward and against the anvil member during a stapling operation, the improvement including:

means for producing the transmission of light through the magazine when a predetermined number of staples are present therein; and means for mounting said means for directing light rays and said means for producing a signal to the base member of the apparatus to be movable therewith.

* * * * *